United States Patent [19]

Newville

[11] Patent Number: 4,923,051

[45] Date of Patent: May 8, 1990

[54] COLLAPSIBLE SAWHORSE

[76] Inventor: Gerald E. Newville, 4747 Capital Ave., Omaha, Nebr. 68132

[21] Appl. No.: 250,770

[22] Filed: Sep. 28, 1988

[51] Int. Cl.[5] ..... B27B 21/00; B25H 1/06

[52] U.S. Cl. ..... 182/151; 182/181

[58] Field of Search ..... 182/151, 181–185, 182/224

[56] References Cited

U.S. PATENT DOCUMENTS

| | | | |
|---|---|---|---|
| 467,081 | 1/1892 | Church | 182/151 |
| 3,035,660 | 5/1962 | Leon | 182/151 |
| 4,105,091 | 8/1978 | Mahan | 182/151 |
| 4,182,432 | 1/1980 | Cossitt | 182/151 |
| 4,433,753 | 2/1984 | Watson | 182/151 |
| 4,574,917 | 3/1986 | Stoddard | 182/151 |

*Primary Examiner*—Reinaldo P. Machado
*Attorney, Agent, or Firm*—John A. Beehner

[57] ABSTRACT

A collapsible sawhorse includes an elongated upright base plate having a pair of upright slots opening through the bottom edge thereof and a pair of leg plates, each with an upright slot opening through the top edge thereof for a fitted slot connection to the base plate. Upon alignment of the slots in the leg plates and base plate, the leg plates are received by the base plate to the extent of engagement of the closed ends of the aligned slots whereby the leg plates are stationarily secured relative to the base plate. The base plate has a transversely extended top surface which, when inverted, serves to support the disassembled leg plates in parallel stacked engagement with the base plate for compact transport and storage.

11 Claims, 2 Drawing Sheets

COLLAPSIBLE SAWHORSE

BACKGROUND OF THE INVENTION

The present invention is directed generally to an improved sawhorse and more particularly to a strong sawhorse which may be readily collapsed into a substantially planar package for compact transport and storage.

Finish carpenters may use as many as six or more sawhorses on a particular job. It is important that the sawhorses be strong and stable for effective use on many jobs over a long period of time.

The sawhorses commonly used by carpenters to date are either permanently assembled wood sawhorses or the type wherein a pair of metal hinges are adapted to receive 2×4 boards for the crossbar and legs. The former type is ideal for on-the-job work but is so large and cumbersome as to make transport and storage difficult. Six permanently assembled wood sawhorses fill a substantial portion of a pickup truck box leaving less room for materials and tools. Furthermore, the carpenter would have to make numerous trips to carry six sawhorses back and forth from his truck to the job site. Likewise, substantial space would have to be reserved at the carpenter's shop or home for storing the sawhorses when not in use. The alternative metal hinged sawhorse assemblies are generally too weak for full-time use and therefore become damaged and disabled.

Special purpose benches and tables for sawing have been designed but these are generally too cumbersome and ill-suited for use as a common sawhorse. The sawhorse of Downey U.S. Pat. No. 3,225,865 has legs connected to a horizontal cross board by hinges and secured in the working positions thereof by gusset boards connectible to the top cross board by removable hinge pins. This structure is not suited for heavy work and is rendered inoperative if the removed hinge pins are lost.

Accordingly, a primary object of the invention is to provide an improved collapsible sawhorse.

Another object is to provide a sawhorse which is strong and stable for heavy work when assembled yet which may be readily collapsed for compact transport and storage.

Another object is to provide a collapsible sawhorse designed such that several of the collapsed sawhorses may be carried by a single worker.

Another object is to provide a collapsible sawhorse with a vertically disposed crossbar for strong support of a work piece.

Another object is to provide a collapsible sawhorse which may be readily assembled and disassembled without tools.

Another object is to provide a collapsible sawhorse in which the disassembled legs and crossbar are stacked in flush engagement for compact storage.

Finally, another object is to provide a collapsible sawhorse which is simple and rugged in construction, economical to manufacture and efficient in operation.

SUMMARY OF THE INVENTION

The collapsible sawhorse of the present invention includes a pair of leg plates each having an upright slot opening through the top edge thereof and an elongated upright base plate having a pair of upright slots opening through the bottom edge thereof. Upon alignment of the respective slots of the base plate and leg plates, the leg plates are received by the base plate to the extent of engagement of the closed ends of the aligned slots whereby the leg plates are stationarily secured relative to the base plate. Releaseable fasteners may be provided for temporarily securing the leg plates to the base plate during use of the sawhorse. Upon removal of the leg plates from the slotted connection to the base plate, means are provided for supporting the leg plates in generally parallel stacked engagement with the base plate for compact transport and storage of the disassembled sawhorse.

A generally horizontal top surface is connected to and extends transversely outwardly from the top edge of the base plate to provide a stable and substantial work surface. The top surface further includes a downwardly extended flange partially defining a pocket between the base plate and flange for temporarily receiving and supporting a leg plate in generally stacked engagement against the base plate upon disassembly of the sawhorse and inversion of the base plate. The spacing between the flange and base plate is preferably such that the leg plate is received in press fit relation therein. By providing a pocket on both sides of the base plate, the disassembled sawhorse can be arranged into a balanced compact package for transport and the horizontal top surface, upon inversion of the base plate, affords stable support for the disassembled sawhorse package. A handle opening through the base plate adjacent the bottom edge thereof enables the disassembled sawhorse package to be easily and conveniently carried. Cutout openings in the bottom edge of each leg plate afford weight reduction and greater stability by reducing the contact surface of the leg plate with the ground. The cutout openings are strategically positioned to match up with fasteners on the base plate so as not to interfere with flush engagement of the leg plates against the base plate upon disassembly of the sawhorse and placement of the leg plates into the support pockets of the base plate. The pockets are designed to receive the leg plates in press fit relation so that no separate fasteners are required for connecting the disassembled leg plates to the base plate.

DESCRIPTION OF THE PREFERRED EMBODIMENTS

Figure 1:
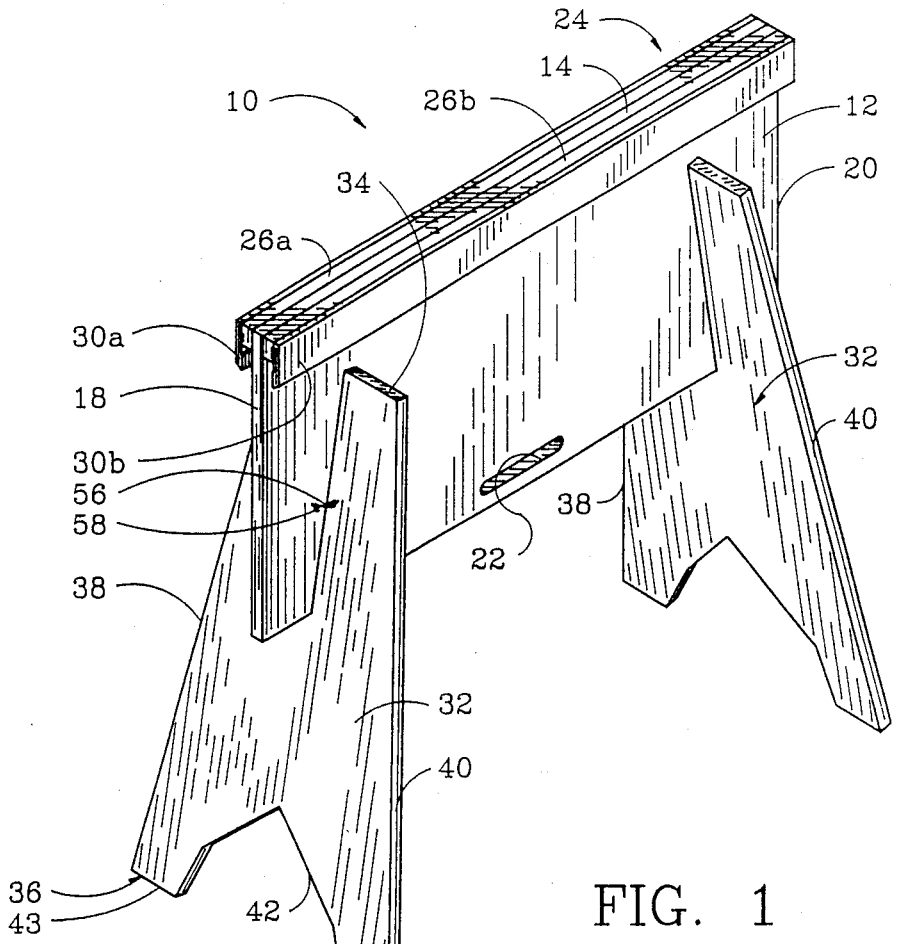
FIG. 1 is a perspective view of the collapsible sawhorse or the invention.
Figure 2:
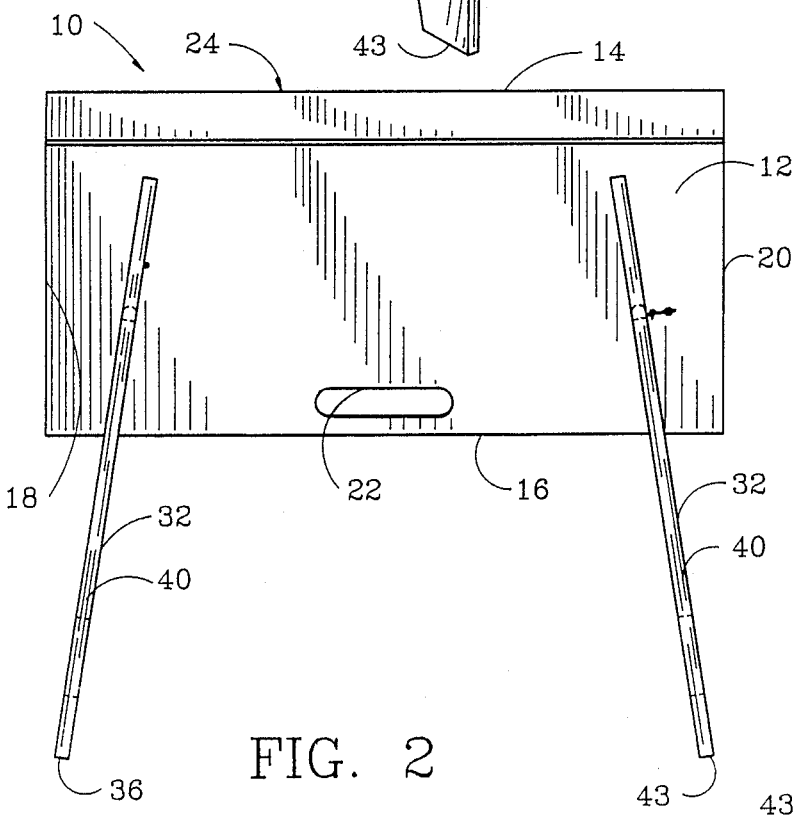
FIG. 2 is a side elevational view of the assembled sawhorse.
Figure 3:
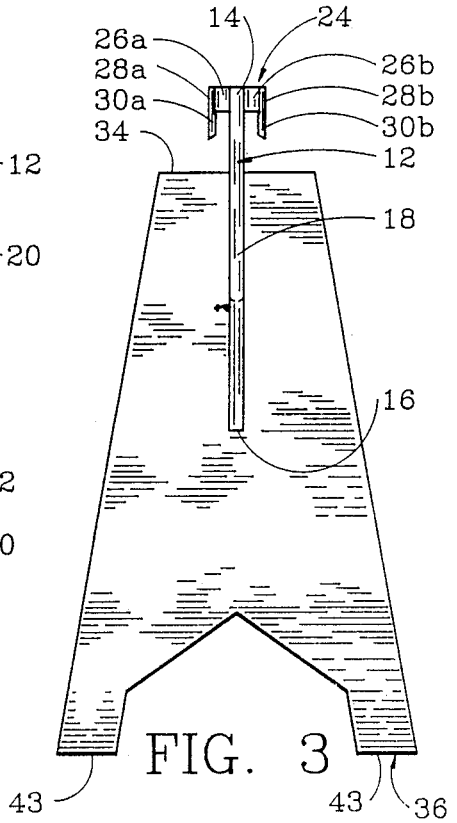
FIG. 3 is an end elevational view of the assembled sawhorse.

The collapsible sawhorse 10 of the present invention is illustrated in FIGS. 1–3 in assembled relation. Sawhorse 10 includes an elongated upright base plate 12 having top and bottom edges 14 and 16 and longitudinally spaced apart opposite ends 18 and 20. A handle opening 22 is cut out at a longitudinally centered position adjacent bottom edge 16.

Figure 6:
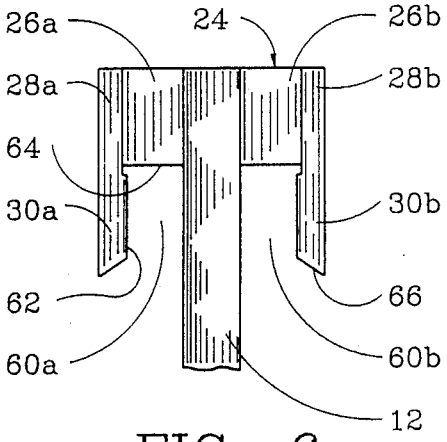
FIG. 6 is an enlarged partial detail end view of the pockets at top edge of the base plate.

A top surface 24 is rigidly connected to and extended transversely outwardly from the base plate 12 adjacent the top edge 14 thereof. The top surface 24 may in fact include top edge 14 as illustrated in FIGS. 1–3. In that embodiment, top surface 24 is formed by an assembly of the base plate 12 with a pair of spacer boards 26*a* and *b* and a pair of edge boards 28*a* and *b* which form downwardly extended flanges 30*a* and *b*, as shown best in FIG. 6 and described in further detail hereinbelow. These members of the top surface 24 are preferably pinned and glued to form a solid unitary member. The base plate 12, in the preferred embodiment, is a piece of ¾ inch or 1 inch thick plywood and the edge boards 28*a* and *b* are preferably formed from standard molding boards with spacer boards 26*a* and *b* likewise being formed of wood. Alternately, the base plate and top surface assembly could be integrally molded or otherwise formed of plastic, aluminum or any other suitable material.

Base plate 12 is assembled with a pair of leg plates 32 to form the sawhorse of the invention. Each leg plate has top and bottom edges 34 and 36 and transversely spaced apart opposite side edges 38 and 40. The side edges are preferably inclined upwardly and inwardly toward one another for reducing both the size and weight of the leg plates without compromising on strength. The bottom edge 36 of each leg plate includes a raised cutout opening 42 for further weight reduction and greater stability. The greater stability results from the reduced length of bottom surface in contact with the ground, that contact surface simply being the horizontal aligned foot surfaces 43.

Whereas it is not critical to the invention, it is preferred that both the leg plates 32 and base plate 12 are symetrically formed relative to a vertical plane through the center of each member.

Figure 4:
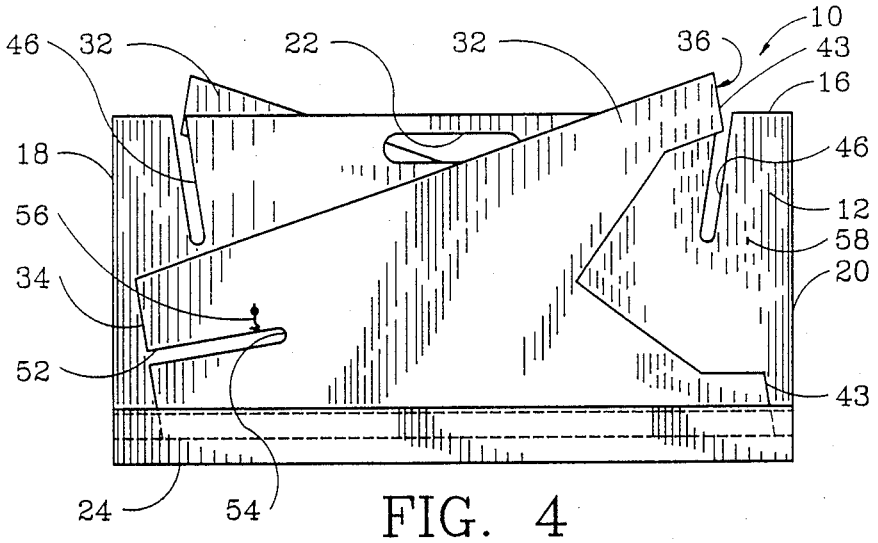
FIG. 4 is a side elevational view of the disassembled sawhorse with the leg plates placed in the base plate pockets for transport and storage.
Figure 7:
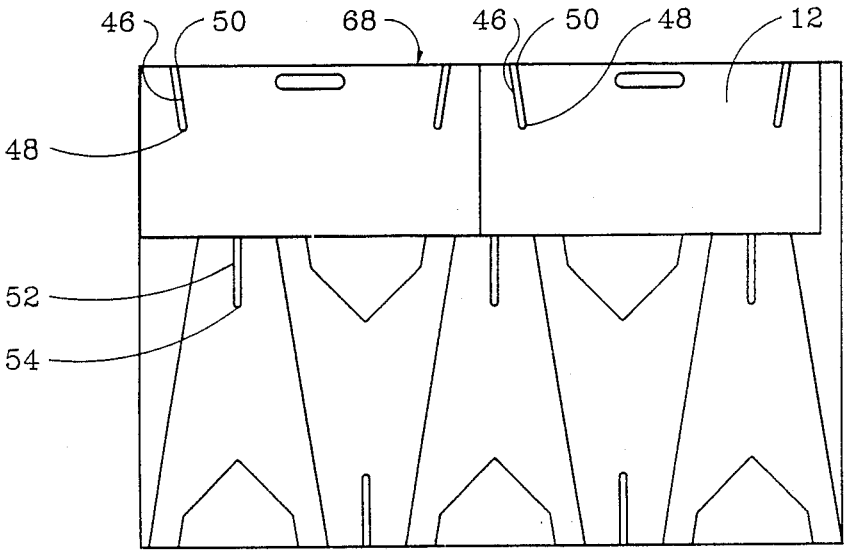
FIG. 7 is a plan view of the blank from which plates of the invention are cut.

Assembly of the leg plates 32 to the base plate 12 is easily accomplished without any tools. As shown in FIGS. 4 and 7, base plate 12 has a pair of upright slots 46 opening through the bottom edge 16 thereof. Each slot 46 has a closed end 48 and an open end 50. The slots 46 are preferably of uniform width, which width corresponds to the thickness of a leg plate 32 so that the slot will be completely filled by a leg plate inserted therein. The pair of upright slots 46 in base plate 12 are preferably inclined upwardly and interiorly relative to the base plate so that the assembled leg plates 32 will be oppositely inclined downwardly and exteriorly from the base plate for greater stability.

In this description, the words inwardly and outwardly are used to refer to opposite transverse directions toward and away from the base plate 12 and interiorly and exteriorly are used to refer to opposite longitudinal directions toward and away from a transverse vertical plane through the longitudinal center of the base plate 12.

Likewise, each leg plate 32 has an upright slot 52 opening through the top edge 34 thereof for receiving that portion of base plate 12 above the slots 46. Each leg plate slot 52 is preferably of uniform width corresponding to the thickness of base plate 12 so that, upon assembly, the base plate completely fills the leg plate slot 52.

Assembly of the sawhorse 10 simply requires alignment of the leg plate slots 52 with the base plate slots 46 and then movement of the leg plates 32 toward the base plate 12 to the extent of engagement of the closed ends 48 and 54 of the respective slots. Base plate 12 is thus stationarily secured relative to the leg plates 32. Transverse pivotal movement of the legs relative to the base plate is prevented by engagement of the edges of the leg slots 52 with the surface of base plate 12 and longitudinal pivotal movement of the leg plates 32 relative to base plate 12 is prevented by engagement of the edges of the base plate slots 46 with the surfaces of leg plates 32. Any work pieces or other loads placed on top surface 24 simply further ensure engagement of the closed ends of the interfitted slots for a most rigid and stable assembly of the collapsible sawhorse.

To facilitate movement of the assembled sawhorse, co-acting fastening means such as the hook and eyes 56 and 58 may be mounted on the leg plates 32 and base plate 12 respectively for temporarily preventing withdrawal of the leg plates from the base plate when the base plate is lifted. Such fasteners are easily disengaged when the sawhorse is to be disassembled. Whereas hook and eye fasteners are illustrated in the drawings, any other suitable and releaseable fastening means may be used.

Figure 5:
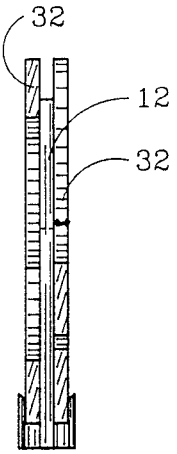
FIG. 5 is an end elevational view of the disassembled sawhorse of FIG. 4.

Upon disassembly of the leg plates 32 from base plate 12, the base plate is inverted whereupon the flanges 30*a* and *b* partially define open-topped pockets 60*a* and *b* with spacer boards 26*a* and *b* and base plate 12. One side edge of each leg plate is inserted into a pocket 60*a* or 60*b* on each of opposite sides of the base plate with the base plate sandwiched in flush engagement between the two leg plates 32 as illustrated in FIGS. 4 and 5. Note that the fastening eyes 58 on base plate 12 are positioned for registration with the cutout opening 42 of the leg plates 32 so as not to interfere with flush engagement of the leg plates and base plate.

The width of pockets 68*a* and *b* is preferably of sufficiently close tolerance relative to the thickness of leg plates 32 as to afford a press fit connection when the leg plate is inserted into the pocket. Each pocket 60 is seen as including an open end 62 and a closed end 64. The press fit of the leg plate 32 into the pocket 60 is facilitated by the inclined edge 66 of flange 30 as well as by the increased width of the pocket 60 adjacent the closed end 64 relative to the width adjacent the open end 62. That increased width is effected by a decreased thickness of the edge boards 28*a* and *b* 263 adjacent to spacer boards 26*a* and *b*. This stepped construction is provided in commercially available molding boards for economical forming of the edge boards 28*a* and *b*. The edge boards are sufficiently flexible to accommodate a slight pinching of the leg plates 32 within the pockets to maintain them in stationary positions therein. The usual slight warpage of any plywood board further contributes to the press fit of the leg plate 32 within pocket 60 even if the width of the pocket is the same as or very slightly greater than the thickness of leg plate 32.

FIG. 7 illustrates that a pair of base plates 12 and several leg plates 32 may be very efficiently cut from a single rectangular plank 68, preferably a board of ¾ inch or 1 inch plywood.

The dimensions of the collapsible sawhorse 10 are not critical to the present invention. Whereas the common height for a sawhorse is approximately 30 inches, the assembled sawhorse of the present invention has the top surface 24 thereof disposed 38 inches above the ground or floor so as to be convenient for finish carpentry work. Each leg plate 32 in that embodiment has a height of 32 inches.

Whereas the invention has been shown and described in connection with a preferred embodiment thereof, it is understood that many modifications, substitutions and additions may be made which are within the intended broad scope of the appended claims. For example, the angle of inclination of the leg plates 32 relative to base plate 12 may be varied somewhat but the disclosed angle is preferred as the optimum compromise for both vertical support and longitudinal stability. The peripheral shape of leg plates 32 may be varied quite dramatically without changing the positional relationship of the slot 52 relative to the ground engaging foot surfaces 43. Likewise, a single pocket of double thickness could be provided on one side of the base plate for receiving both leg plates but the disclosed arrangement is preferred both for strength and stability.

Thus there has been shown an described and improved collapsible sawhorse which accomplishes at least all of the stated objects.

I claim:

1. A collapsible sawhorse, comprising an elongated upright base plate having top and bottom edges and longitudinally spaced apart opposite ends, a pair of leg plates, each having top and bottom edges and transversely spaced apart opposite side edges, each leg plate having an upright slot opening through the top edge thereof, said slot having open and closed ends and being adapted for receiving said base plate, said base plate having a pair of upright slots opening through the bottom edge thereof, each slot having open and closed ends and being adapted to receive a respective leg plate, upon alignment of the respective slots of said base plate and leg plate, to the extent of engagement of the closed ends of the aligned slots whereby said leg plates are stationarily secured relative to said base plate, said base plate further comprising a generally horizontal top surface extended transversely outwardly from said base plate, and means for temporarily supporting said leg plates, upon removal from the slotted connection to said base plate, in generally parallel stacked engagement with said base plate for compact transport and storage of said sawhorse, said top surface includes a downwardly extended flange partially defining a pocket between said base plate and flange for temporarily receiving and supporting a leg plate in generally stacked engagement with said base plate upon inversion of the base plate.

2. The collapsible sawhorse of claim 1 wherein the spacing between said flange and base plate is such that said leg plate is received in press fit relation there between.

3. The collapsible sawhorse of claim 1 wherein said top surface extends traversely outwardly from said base plate in opposite directions, said top surface further comprising a second downwardly extended flange on the opposite side of said base plate relative to the aforementioned flange, said second flange partially defining a second pocket.

4. The collapsible sawhorse of claim 1 wherein said pocket includes vertically spaced apart closed and open ends, the width of said pocket adjacent said open end being less than the width of said pocket adjacent the closed end, thereby to contribute to the press fit of a leg plate in said pocket.

5. The collapsible sawhorse of claim 1 wherein said pair of upright slots in said base plate are inclined upwardly and interiorally relative to said base plate whereby, upon assembly of said base plate and leg plates, said leg plates are oppositely inclined downwardly and exteriorally from said base plate for greater stability.

6. The collapsible sawhorse of claim 5 wherein the width of the slot in each leg plate is substantially equal to the thickness of said base plate.

7. The collapsible sawhorse of claim 6 wherein the width of each slot in said base plate is substantially equal to the thickness of each respective leg plate.

8. The collapsible sawhorse of claim 7 wherein said leg plates are identical to one another and thereby interchangeable.

9. The collapsible sawhorse of claim 1 further comprising a handle opening through said base plate adjacent the bottom edge thereof for carrying the disassembled sawhorse upon inversion of the base plate.

10. The collapsible sawhorse of claim 11 wherein the side edges of each leg plate are inclined upwardly and inwardly toward one another.

11. The collapsible sawhorse of claim 10 wherein the bottom edge of each leg plate defines an upwardly extended cutout opening whereby ground support is afforded by foot surfaces adjacent the outer ends of said bottom edge.

* * * * *